US005516231A

United States Patent [19]

Heims et al.

[11] Patent Number: 5,516,231

[45] Date of Patent: May 14, 1996

[54] VIBRATORY SCREED FOR A ROAD FINISHER

[75] Inventors: Dirk Heims, Bad Münder; Robert Prang, Hameln, both of Germany

[73] Assignee: Ingersoll-Rand Company, Woodcliffe Lake, N.J.

[21] Appl. No.: 354,172

[22] Filed: Dec. 12, 1994

[30] Foreign Application Priority Data

Dec. 15, 1993 [DE] Germany ..... 43 42 803.7
Mar. 26, 1994 [DE] Germany ..... 44 10 537.1

[51] Int. Cl.[6] ..... E01C 19/30; E01C 19/40

[52] U.S. Cl. ..... 404/102; 404/114; 404/133.05

[58] Field of Search ..... 404/102, 114, 404/133.05, 133.1, 133.2, 118

[56] References Cited

U.S. PATENT DOCUMENTS 4,493,585 1/1985 Axer ..... 404/118 X
4,502,813 3/1985 Hojberg ..... 404/102
4,507,014 3/1985 Heims et al. ..... 404/102
4,828,428 5/1989 Anderson ..... 404/102

FOREIGN PATENT DOCUMENTS 1142568 2/1985 U.S.S.R. ..... 404/102
1308670 5/1987 U.S.S.R. ..... 404/118

*Primary Examiner*—Ramon S. Britts
*Assistant Examiner*—James A. Lisehora
*Attorney, Agent, or Firm*—John J. Selko

[57] ABSTRACT

The invention relates to a vibratory packing plank for a road finisher, having a vibration unit, which comprises a vibration element exhibiting a large-area base plate and coupled to a vibration drive, and a guide plate positioned obliquely towards the base plate, a vibration strip being disposed between the guide plate and the base plate of the vibration unit, which vibration strip is coupled to the vibration drive and provided with a run-in slope.

19 Claims, 2 Drawing Sheets

VIBRATORY SCREED FOR A ROAD FINISHER

BACKGROUND OF INVENTION

The invention relates to a vibratory packing plank for a road finisher, having a vibration unit, which comprises a vibration element exhibiting a large-area base plate and coupled to a vibration drive, and a guide plate positioned obliquely towards the base plate.

Road finishers conventionally comprise a packing plank, especially having a basic plank body which is divided for the adjustment of a roof profile and which can usually be widened to either side by an extendible plank and, where appropriate, additionally by plank parts which can be manually pieced together. The packing plank can also however be designed as a so-called "rigid" construction, i.e. the different packing widths are achieved by the attachment of plank extensions to both sides of the basic plank. The packing plank is pivotally attached to the road finisher by two traction arms, so that it is able to float on the material to be packed. As a tamping vibration plank, it can comprise a combination of a tamping and a vibrating device, the tampers and vibration elements of which are disposed one behind the other in the direction of travel.

From EP-B-0 115 567, a packing plank of this type is known, which is provided with at least two tampers driven by an eccentric shaft, which tampers are disposed one behind the in the direction of travel and to which there is adjoined a vibration element comprising a base plate. Since the vibration drive exerts, via the large-area base plate, only a small specific surface pressure upon the packing material, the compacting effect of the vibration is restricted relative to the tamping compaction. Especially in the production of very thin packing layers, the compacting effect of the rear tamper in the direction of travel, which compacting effect is too high for this packing instance, can result in the packing plank being raised in the rear region, thereby impairing its compacting effects.

Furthermore, packing planks are known in which at least one vibration strip provided with a run-in slope is located behind the base plate of the packing plank in the direction of travel. The compacting effect of the vibration strips is restricted, in particular on an uneven foundation such as, for example, where lane grooves are built upon, since no fresh packing material is able to be supplied to the vibration strip. The result of this is an irregular compaction.

The foregoing illustrates limitations known to exist in present vibratory packing planks. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a vibratory packing plank for a road finisher, having a vibration unit, which comprises a vibration element exhibiting a large-area base plate and coupled to a vibration drive; a guide plate positioned obliquely towards the base plate; and a vibration strip disposed between the guide plate and the base plate of the vibration unit, which vibration strip is coupled to the vibration drive and provided with a run-in slope.

The foregoing and other aspects will become apparent from the following detailed description of the invention when considered in conjunction with the accompanying drawing figures.

BRIEF DESCRIPTION OF THE DRAWING FIGURES

FIG. 1 shows a tampering vibration plank, schematized in side view and partially in section, with schematized, adjacent parts of a road finisher; and FIG. 2 shows a vibratory packing plank, schematized in side view and partially in section, with schematized, adjacent parts of a road finisher.

DETAILED DESCRIPTION

Figure 1:
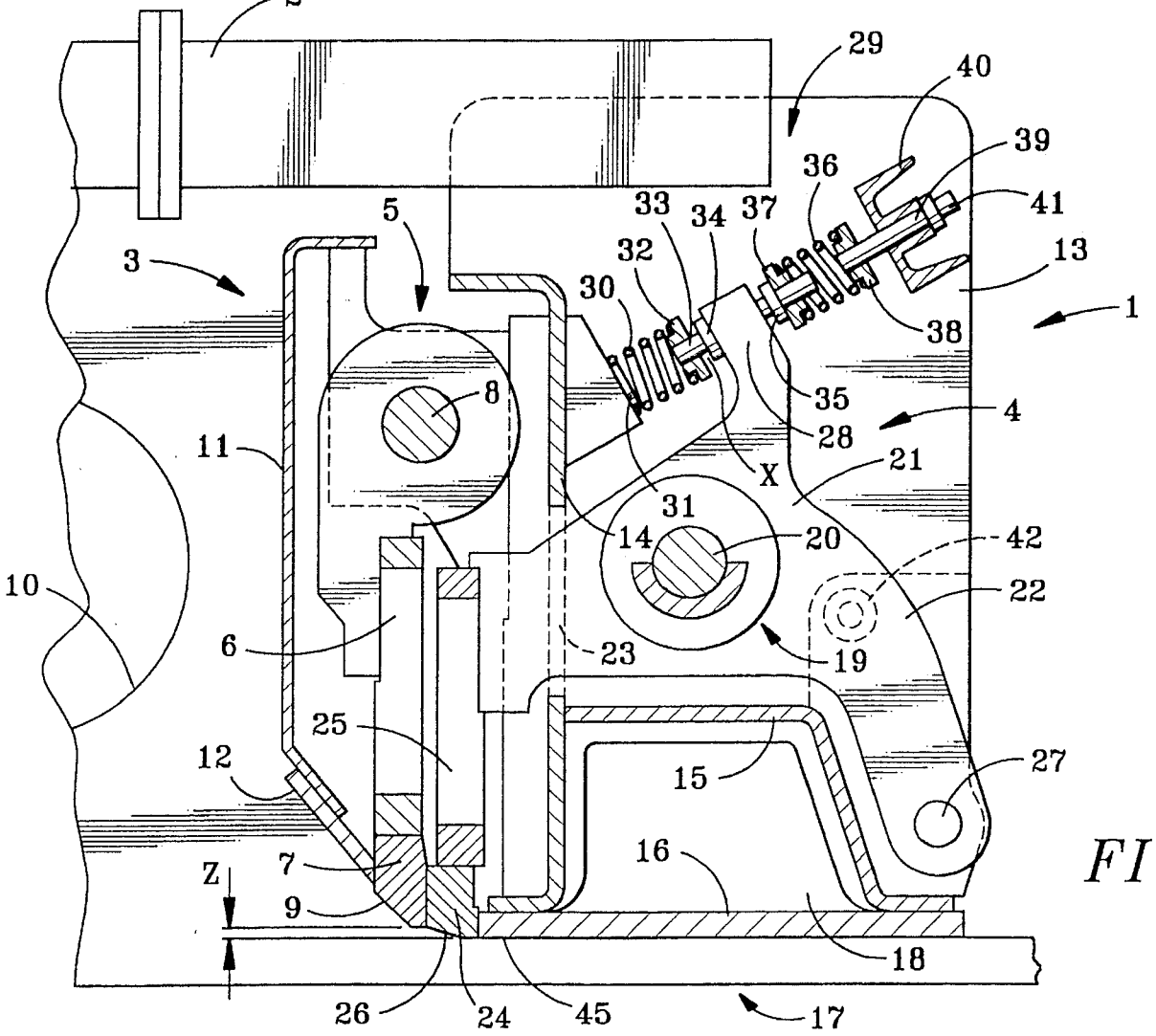

The tamping vibration plank 1 represented in FIG. 1 is fastened to traction arms 2 of a road finisher, which connect the tamping vibration plank 1 to the road finisher in an articulated and height-adjustable manner. The tamping vibration plank 1 comprises a tamping unit 3 and a vibration unit 4.

The tamping unit 3 comprises a tamper drive 5, which, via an eccentric shaft 8, propels a tamper 6, and hence a tamping strip 7 fastened to the lower end of said tamper, into a vertical lift motion. The tamping strip 7 is provided at its front edge with a run-in slope 9.

The tamping vibration plank 1 exhibits in the direction of a spreader screw 10 of the road finisher, which spreader screw supplies the packing material, a front wall 11 having a guide plate 12 which is inclined downwards and rearwards at approximately the same angle as the run-in slope 9 of the tamping strip 7 and terminates flush with the tamping strip 7. The tamping strip 7 meters the packing material supplied by the spreader screw 10 and pre-compacts it.

The vibration unit 4 comprises a housing 13 connected to the traction arms 2. A front wall 14 of the housing serves to fasten the tamping unit 3. A bottom side 15 of the housing 13 is connected to a base plate 16 in such a way that a vibration element 17 and a heating chamber 18 are configured. A vibration drive 19, comprising a shaft 20, is located above the heating chamber 18 in a pipe 21 increasing the torsional stiffness, which pipe connects at least two bell-crank-like supporting arms 22 situated one behind the other in the drawing plane. The front side of the supporting arms 22 in the direction of travel reaches through an opening 23 in the front wall 14 of the housing 13. A vibration strip 24 is connected by a crosspiece 25 to the supporting arms 22 on the front side in the direction of travel. The vibration drive 19 acts, via the supporting arms 22, on the one hand upon the vibration element 17 comprising the base plate 16 and on the other hand upon the vibration strip 24.

The vibration strip 24 exhibits, at is front edge, a run-in slope 26 and is located behind the tamping strip 7 in the direction of travel of the road finisher. The height difference Z between the vibration strip 24 and the tamping strip 7 is continuously adjustable. Expediently, furthermore, the run-in slope 9 of the tamping strip 7 is substantially steeper than that of the vibration strip 24. The angle of the run-in slope 9 of the tamping strip 7 advantageously ranges from 30° to 70°, whilst the angle of the run-in slope 26 of the vibration strip 24 advantageously ranges from 10° to 30°. Such a configuration of the angles of the run-in slopes 9, 26 extending over a front portion of the tamping strip 7 and vibration strip 24 respectively thus ensures that the pre-compacted packing material is optimally further treated by the vibration unit 4. By virtue of the tamping operation of the tamper 6, non-compacted packing material piled up before the tamper 6 is metered and pre-compacted, and further compacted, such that is metered, by the subsequent vibration strip 24.

The vibration element 17 is attached to the bell-crank-like supporting arms 22 so as to be rotatable about bearings 27 disposed in the rear region in relation to the direction of travel. The supporting arms 22 exhibit a continuation 28 connected to an adjusting device 29.

The adjusting device 29 comprises a first pressure spring 30, which is guided by a journal 31 connected to the housing 13. The pressure spring 30 is supported, opposite the journal 31, against a pressure plate 32 connected fixedly to a threaded rod 33. The threaded rod 33 is guided adjustably in the threaded bore of the continuation 28 and is fixed by means of a check nut 34.

For the spring centering of the continuation 28 and hence of the vibration strip 24, a second equal-sized pressure spring 36 is disposed between an adjusting nut 37 and a pressure plate 38. The adjusting nut 37 is seated on the threaded rod 33. The pressure plate 38 is seated fixedly on one end of a further threaded rod 39. The rotationally symmetrical axis of the threaded rods 33, 39, the pressure springs 30, 36, the adjusting nut 37, the pressure plates 32, 38 and the check nuts 34, 35 forms an angle with the horizontal in the direction of travel, which angle derives from the tangent to the center of rotation about bearing 27. The adjusting device 29 is connected on the side opposite the journal 31, by a further mounting 40, to the housing 13 of the vibration unit 4. By suitable rotation of the adjusting nut 37 and the threaded rod 33, the spring tensions of the pressure springs 30 and 36 can be independently adjusted and the zero position of the vibration strip 24 can thus be set.

By rotation of the threaded rod 39 - via a further journal 41 at the free end of the threaded rod 39, by means of spindles or hydraulic cylinders - the pretensioning upon the pressure springs 30, 36 and hence the force acting, via the supporting arms 22, upon the base plate 16, the vibration element 17 and the vibration strip 24 can be varied.

The acting forces are additionally divisible by means of the adjusting device. The divisibility of the forces is made possible in combination with the described deflecting movement of the vibration element 17 in the rear region bearing 27 of the supporting arms 22. The check nut 34 exhibits, in relation to the pressure plate 32, a clearance X, which is variable by rotation of the threaded rod 33 when the check nut 34 is loosened. In particular, a diminution of the clearance X results in the forces imparted by the supporting arms 22 being divided in favor of the vibration strip 24, this by comparison with the vibration element 17 inclusive of the base plate 16.

The pretensioning, which can be varied using spindles or hydraulic cylinders, results in adjustability of the force to be spread over the vibration strip 24 and the vibration element 17 as a whole and hence of the specific surface pressure which maximally acts upon the packing material. The surface pressure can hereby be matched to the nature of the packing material. The independent adjustability of the respective spring tensions serves, at a certain operating frequency of the vibration unit 4, to prevent resonances whilst the aforementioned spring centering is maintained.

The position of the vibration strip 24 relative to the front edge of the base plate 16 is limited in the upper setting by an elastic, adjustable stop 42, which can be adjustable in its setting. The bottom edge of the vibration strip 24 is thereby prevented from being able to assume a higher setting than the bottom edge of the base plate 16. Any such setting of the vibration strip 24 would namely have an adverse effect upon the surface structure of the packed layer. For the elastic stops 42, corresponding rubber buffers or rubber-elastic material elements can be considered.

In place of the pressure-spring centering, comprising helical springs or leaf-spring assemblies, of the supporting arms 22, a spring centering in the form of a rubber-elastic material centering 43 can also, for example, be used.

Figure 2:
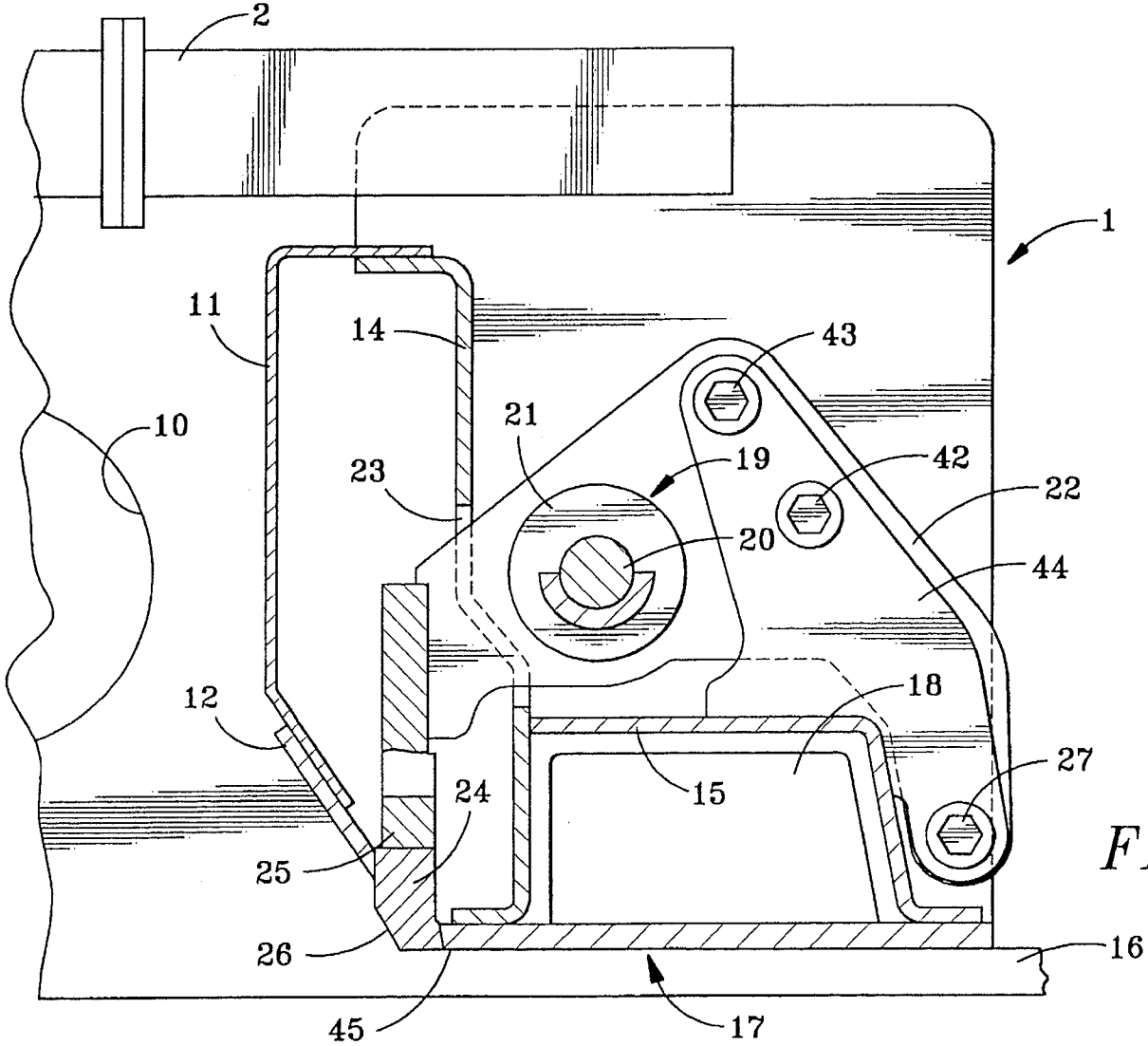

In the embodiment, represented in FIG. 2, of a vibratory packing plank 1 without a tamper, the supporting arms 22 are provided with a rubber-elastic material centering 43, which is adjustable by means of eccentric bushings (not represented).

The bearing 27 of the supporting arms 22 in the rear region are likewise configured as rubber-elastic material elements, which exhibit however a very high spring stiffness both in the rotary and in the radial direction.

The thus quasi-elastic suspension of the supporting arms 22 from the plank body 13 (the supporting arms 22 are respectively disposed between two cheeks 44 of the plank body 13 which are fastened to the bottom plate 15, the cheeks 44 holding, on the end side, the rubber elastic material components 27, 43 and where appropriate, 42 (for the mounting, spring centering and stop) not only results in a clear noise reduction during the packing operation, but also in a substantial compaction enhancement, since the lift of the vibration strip 24 can hereby be substantially increased, for example to approx. 4 or 5 mm, should the resonance frequency be exceeded.

To this end, it is expedient to propel the vibration unit 4 by hydraulic or electrical means, so that the frequency and amplitude are readily continuously adjustable.

The run-in slope 26 on the vibration strip 24 of the embodiment of FIG. 2 herein exhibits an angle of approx. 30° to 70° so as to obtain satisfactory metering of the loose mixed material, i.e. the same compacting effect at different packing thickness. The width of the vibration strip 24 can be matched to the packing speed.

The base plate 16 can exhibit at the front, in the direction of packing, a slight run-in slope 45.

In the embodiment of FIG. 1, the tamper unit 5 is able, where appropriate, to be disabled for small packing thicknesses and the vibration unit 4 operated within the super critical zone.

Thus, it can be understood that this invention provides a vibratory packing plank which produces a very high compaction of the packing material without the packing plank being raised in the rear region, in particular in the production of thin packing layers.

This result is achieved by the fact that a vibration strip is disposed between the guide plate and the base plate of the vibration unit, which vibration strip is coupled to the vibration drive and provided with a run-in slope.

As a result of the coupling of a vibration strip to the vibration drive for a base plate, the vibration strip provided with a run-in slope being disposed in front of the base plate in the direction of packing, the lift of the vibration strip, which lift is normally less than about 1 mm is substantially increased, for example to approx. 4 to 5 mm, whenever the resonance frequency of the vibrating device is exceeded, i.e. where working takes place within the super critical zone, so that the vibration strip acts as a tamper and can jointly perform the function of a tamper, especially in the packing of thin layers, in that it can be made to impact upon mixed material to be packed, which has not yet been pre-compacted by a tamper, without there being any risk of raising.

In an arrangement of a vibration strip between a single or double tamper disposed at the front in the direction of travel and the vibration element comprising a base plate, there is placed after the tamper(s) having the vibration strip and element exhibiting higher specific surface pressure, which element leads to a compaction enhancement in the packing material pre-compacted by the tamping unit. By the use of a run-in slope on the vibration strip, both the compaction enhancement and the metering dosage of the material presented on the tamper side is guaranteed.

What is claimed:

1. A vibratory packing plank for a road finisher, having a vibration unit, which comprises a vibration element exhibiting a large-area base plate and first coupling means coupled to a vibration drive, for vibrating the vibration element; a guide plate positioned obliquely towards the base plate; a vibration strip disposed between the guide plate and the base plate of the vibration unit; and second coupling means coupled to the vibration drive, for vibrating the vibration strip, the vibration strip being provided with a run-in slope, whereby the vibration element and the vibration strip can move independently of each other.

2. The vibratory packing plank as claimed in claim 1, wherein the vibration drive is coupled, via a plurality of supporting arms, to the vibration strip and the vibration element.

3. The vibratory packing plank as claimed in claim 2, wherein the supporting arms are mounted rotatably about bearings disposed in a rear region of said vibration unit in relation to a direction of travel of said road finisher.

4. The vibratory packing plank as claimed in claim 3, wherein the bearings include elastic material exhibiting high stiffness both in a radial and in a rotary direction.

5. The vibratory packing plank as claimed in one of claims 1 to 4 further comprising means for applying a force to elastically center the vibration strip at a zero point.

6. The vibratory packing plank as claimed in claim 5, wherein the force to center the vibration strip is variable.

7. The vibratory packing plank as claimed in claim 6, wherein the force to center the vibration strip is provided by elastic springs.

8. The vibratory packing plank as claimed in one of claims 1 to 4, further comprising means for adjustably dividing force supplied by the vibration drive to the vibration strip and the vibration element.

9. The vibratory packing plank as claimed in one of claims 1 to 4, wherein the vibration drive is continuously adjustable with respect to frequency and amplitude.

10. The vibratory packing plank as claimed in claim 2, wherein the supporting arms are configured in the style of a bell-crank.

11. The vibratory packing plank as claimed in claim 2, wherein the supporting arms each respectively possess a continuation, which each continuation is spring-centered and, wherein the supporting arms are pivotable, to provide for a division of the forces supplied by the vibration drive to the vibration strip and the vibration element.

12. The vibratory packing plank as claimed in claim 2, wherein the supporting arms are limited in an uppermost setting by an elastic stop.

13. The tamping vibration plank as claimed in claim 12, wherein the elastic stop is adjustable.

14. The vibratory packing plank as claimed in 1, wherein the vibration strip has a run-in slope that essentially exhibits the same angle to the horizontal as the guide plate.

15. The vibratory packing plank as claimed in claim 14, wherein the run-in slope of the vibration strip exhibits an angle to the horizontal of about 30° to 70°.

16. The vibratory packing plank as claimed in claim 1, wherein a tamping unit is provided, which exhibits at least one tamping strip, disposed between the guide plate and the vibration strip, and a tamper drive.

17. The vibratory packing plank as claimed in claim 16, wherein the tamping strip and vibration strip are mutually adjustable in height.

18. The vibratory packing plank as claimed in claim 17, wherein the run-in slope of the vibration strip is substantially flatter than a run-in slope located on a front edge of the tamping strip.

19. The vibratory packing plank as claimed in claim 17, wherein the run-in slope of the vibration strip exhibits an angle of about 10° to 30° and that of the tamping strip an angle of about 30° to 70°.

* * * * *